United States Patent [19]

Daumer

[11] 4,196,711

[45] Apr. 8, 1980

[54] IGNITION SYSTEM WITH IGNITION COIL PRIMARY CURRENT CONTROL

[75] Inventor: Rolf Däumer, Weil der Stadt, Fed. Rep. of Germany

[73] Assignee: Robert Bosch GmbH, Stuttgart, Fed. Rep. of Germany

[21] Appl. No.: 868,063

[22] Filed: Jan. 9, 1978

[30] Foreign Application Priority Data

Jan. 21, 1977 [DE] Fed. Rep. of Germany ..... 2702397

[51] Int. Cl.[2] ..... F02P 3/04

[52] U.S. Cl. ..... 123/148 E; 315/209 T

[58] Field of Search ..... 123/148 E; 315/209 T

[56] References Cited

U.S. PATENT DOCUMENTS

| | | | |
|---|---|---|---|
| 3,324,351 | 6/1967 | Pahl, Jr. | 123/148 E |
| 3,575,154 | 4/1971 | Taylor | 123/148 E |
| 3,709,206 | 1/1973 | Myers | 123/148 E |
| 4,020,816 | 5/1977 | Chateau | 123/148 E |
| 4,084,567 | 4/1978 | Hachiga | 123/148 E |
| 4,105,006 | 8/1978 | Jundt et al. | 123/148 E |
| 4,114,581 | 9/1978 | Wurst | 123/148 E |

FOREIGN PATENT DOCUMENTS

| | | | |
|---|---|---|---|
| 2406018 | 8/1974 | Fed. Rep. of Germany | 123/148 E |
| 2330875 | 6/1977 | France | 123/148 E |

*Primary Examiner*—Ronald H. Lazarus
*Assistant Examiner*—Andrew M. Dolinar
*Attorney, Agent, or Firm*—Frishauf, Holtz, Goodman, Woodward

[57] ABSTRACT

To permit use of integrated circuits in solid-state ignition control systems in which the current through the primary of the ignition is pulsed when a predetermined level is reached, a threshold switch which has switching hysteresis is connected to control conduction of an auxiliary semiconductor connected in parallel with the ignition coil, to control the auxiliary semiconductor to become conductive when the current through the coil rises above a predetermined first threshold level to thereby shunt the primary thereof or to block the auxiliary semiconductor switch when the current through the coil drops below a predetermined second threshold level and thereby removes the shunt from the primary of the ignition coil and permits current flow from a power source thereto to ensure, reliably, alternate opening and closing of the main controlled switch, typically a transistor, in series with the coil and the auxiliary controlled switch.

2 Claims, 2 Drawing Figures

| 1 | 17 | 2 | 3 | 5 | 11 | 15 |
|---|---|---|---|---|---|---|
| I | I | I | I | L | B | L |
| I | O | O | O | B | L | B |
| O | I | I | O | L | B | B |
| O | O | I | O | L | B | B |

IGNITION SYSTEM WITH IGNITION COIL PRIMARY CURRENT CONTROL

Cross reference to related applications, assigned to the assignee of the present invention:

U.S. Ser. No. 703,780, filed July 9, 1976, now U.S. Pat. No. 4,105,006 JUNDT et al German Disclosure Document Pat. No. 2,406,018 U.S. Pat. No. 3,324,351 U.S. Pat. No. 3,575,154 U.S. Pat. No. 3,709,206.

The present invention relates to an ignition system in which the ignition current through the primary of an ignition coil is pulsed after the current has reached a predetermined level so that a certain electromagnetic energy level, once it has been stored, is maintained in the coil without, however, continuing current flow, uninterruptedly, through the coil until an ignition event is commanded by an ignition system.

Background and Prior Art

It has previously been proposed to connect a controlled switch, typically a transistor, in series with the primary of an ignition coil, and additionally to include a sensing device, typically a resistor, in the primary circuit so that current flowing through the primary of the ignition coil can be determined. Based on current flow, as so measured or determined, the current is then interrupted when a certain level is reached, and current flow permitted to continue through the ignition coil and a bypass switch, connected in shunt therewith. When the resulting current flow, due to the stored electromagnetic energy in the coil, has dropped below a predetermined level which is at, or above, the minimum energy necessary to generate a spark, current is again reconnected to the ignition coil to bring it up to a higher level, current then again being disconnected, and so on, until the main switch opens and thereby initiates an ignition event, that is, interrupts current flow through the coil without the shunt bypass being available, thus inducing a high-voltage surge in the secondary of the ignition coil, causing a spark to jump over at a spark plug. The cross-referenced U.S. Pat. No. 3,709,206, to which German Disclosure Document No. 2,232,220 corresponds describes a pulsed electronic ignition system in which a transistor is connected between the battery and the primary of the ignition coil to provide for rhythmic interruption of the current through the ignition coil. The interrupting, main transistor is of a conductivity type which is opposite to the transistor controlling an ignition event. For example, if the transistor to control the ignition evernt is of the NPN type, then, necessarily, the current interrupting transistor will be of the PNP type. This is a disadvantage if the entire ignition system is to be constructed as an integrated circuit, since such structures should, preferably, use transistors of the same type.

The Invention

It is an object to provide a pulsed ignition system which can be controlled with semiconductor elements which are all of the same conductivity type, for example NPN.

Briefly, the ignition coil is connected serially with a source of power to a sensing resistor and to a main ignition control switch. A further control switch is connected across the sensing resistor and the ignition coil to short-circuit the ignition coil when a certain predetermined currrent flow through the ignition coil has been reached; when the current level then has dropped to a second predetermined level, the short circuit is removed. A logic circuit is provided which alternately renders the main ignition switch and the auxiliary or controlled switch conductive, and blocked, respectively. A threshold circuit is connected to the sensing element, typically a sensing resistor, and responsive to the predetermined current level.

The ignition system has the advantage that the switches used therein can be transistors of the same conductivity type, typically all NPN. This permits ready integration of the circuit as a single integrated circuit element, without constructional difficulty, and hence inexpensive mass production of the entire system. The control circuit necessary for the system also is simplified.

Drawings, illustrating an example:

Figures 1, 2:
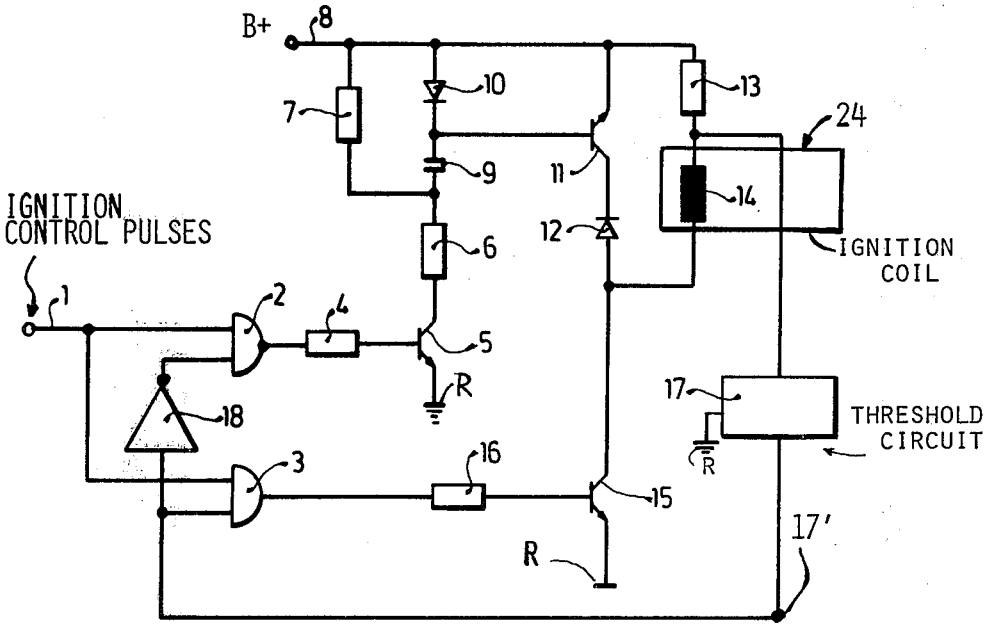
FIG. 1 is a general schematic diagram of the ignition system.
FIG. 2 is a table illustrating signals and conduction states arising in operation of the system.

The input 1 has ignition pulses applied thereto, derived from an ignition pulse source, not shown. Such a pulse source may be a breaker switch, an ignition control system, or a computerized ignition system in which a time instant can be computed with respect to a predetermined angular position of a piston of an internal combustion engine with which the ignition system is being associated. The signals are applied to two input gates, one being a NAND-gate 2, the other an AND-gate 3. The output of NAND-gate 2 is connected over a coupling resistor 4 to the base of a control transistor 5. The emitter of transistor 5 is connected to a common source of reference potential indicated at R, for example the chassis or ground connection in an automotive vehicle. The collector of transistor 5 is connected through a coupling resistor 6 and a further coupling resistor 7 to a positive supply bus 8 connected to a source of supply, generally indicated by B+, the negative terminal of which is connected to the reference bus R. A capacitor 9 is connected to the junction between resistors 6 and 7, the other terminal of which is connected through a blocking diode 10 connected in blocking direction to the supply bus 10. The junction between the capacitor 9 and the diode 10 is connected to the base of an auxiliary transistor 11, the emitter of which is connected to the supply bus 8, and the collector through a diode 12, connected in blocking direction. The other terminal, in the polarity shown the anode of diode 12, is connected to one terminal of the primary winding 14 of an ignition coil 24. The other terminal of the ignition coil is connected to a junction which, on the one hand, is connected through a sensing resistor 13 to the positive supply bus 8 and, on the other, to a threshold circuit 17. The junction of the ignition coil 24 and the anode of diode 12 is additionally connected to the collector of a main current control transistor 15, the emitter of which is connected to the reference bus R. The base of transistor 15 is connected through a resistor 16 to the output of the AND-gate 3. The threshold circuit 17 is connected to the other input of AND-gate 3 and through an inverter 18 to the second input of NAND-gate 2. The threshold circuit 17 is capable of sensing voltage levels, that is, current flow through the coil 14 in two levels, a higher level and a lower level, and switches between respective states, with hysteresis.

Operation, with reference to FIG. 2: Let it be assumed that no signal is applied to terminal 1 from an external ignition control source. Both transistor 11 as well as transistor 15, which are both of the same type, are blocked. No current will flow through coil 14. The threshold switch 17 will provide a signal indicative that current through the primary winding 14 of the ignition coil has not exceeded a first predetermined level. Current through the winding 14 is measured as a voltage drop across the sensing resistor 13.

During continued rotation of the crankshaft of the internal combustion engine with which the ignition system is to be used, an ignition control pulse will appear at terminal 1. The collector-emitter path of transistor 15 will thus become conductive. Due to the inductance of the ignition coil, current will gradually rise through the primary winding 14 thereof. When the current through the ignition coil has reached a first or predetermined or higher level, the threshold circuit 17 will change over. Transistor 15 will block, and transistor 11 will become conductive. No ignition pulse will be induced in the secondary of the ignition coil, however, since a decaying current can flow through the closed series circuit formed by the ignition coil 14, diode 12, the conductive transistor 11, and sensing resistor 13. This current will be due to the energy stored in the ignition coil, and will decay gradually. When the current has decayed to a predetermined second, or lower level, threshold switch 17 will change over and provide a signal at its output. Transistor 11 will block and transistor 15 will become conductive. Upon termination of the pulse applied to terminal 1, that is, at the ignition instant commanded by an ignition control system (not shown), both transistors 11 and 15 will block. Thus, the secondary of the ignition coil (not shown) will have the ignition voltage induced therein.

The operation of the system can best be understood by reference to the table in FIG. 2, in which I signifies the presence of a signal, and 0 signifies absence of a signal; the signals at the ignition control pulse terminal 1 as well as the output terminal 17' of the threshold circuit 17 are shown in the figure, together with the conductivity states of the transistors 5, 11 and 15, in which an L signifies conduction, and a B signifies blocked state.

When input 1 and the output of threshold switch 17 have an I signal, then both the output of NAND-gate 2 as well as the output of AND-gate 3 provide a signal, causing transistor 15 to be conductive, while blocking transistor 11 due to the inverting effect of transistor 5. As the current increases, threshold switch 17 switches over at the first predetermined upper current level and provides a 0-output (line 2 of the table of FIG. 2). This causes blocking of both NAND-gate 2 as well as of AND-gate 3, blocking transistor 15, but causing transistor 11 to become conductive. These conditions, illustrated in lines 1 and 2 of FIG. 2, will occur alternately in repetitive cycles for the duration of the I signal on the ignition control terminal 1.

Upon occurrence of the ignition event, that is, when an ignition spark is to be induced, the signal at terminal 1 changes to a 0-signal, as seen in the third line of the table of FIG. 2. Both transistors 11 and 15 will block. The output of NAND-gate 2 will be a 1-signal, controlling transistor 5 to be conductive. It is irrelevant, however, what the signal from threshold switch 17 is. This condition is illustrated in the third and fourth lines of FIG. 2.

Transistor 11 is reliably controlled to change over, as commanded, by the connection with diode 12. Transistor 5 is reliably controlled by the connection with resistors 6, 7, capacitor 9 and diode 10. These elements ensure rapid and reliable turn-off, or turn on, respectively. Diode 12, connected in blocking direction with respect to the voltage at bus 8 prevents current flow through diode 10 and the collector-base junction of transistor 11 when transistor 15 is conductive, which might trigger transistor 11 to likewise become conductive. Transistor 11 is always reliably blocked when the voltage at the base of transistor 11 is less than, or equal to the supply voltage. This is always the case when the transistor 5 is conductive. Capacitor 9 is then simultaneously charged to a voltage which corresponds to the voltage difference between the voltage on the supply bus 8 and the voltage at resistor 6. Upon blocking of transistor 5, capacitor 9 will discharge over the base-emitter junction of transistor 11. Transistor 11, in that case, will be conductive. Diode 10 is provided to prevent discharge of the capacitor 9 to the supply bus 8, and to ensure reliable and unambiguous switching of transistor 11.

Various changes and modifications may be made within the scope of the inventive concept.

I claim:

1. Ignition system with pulsed current control through the primary of an ignition coil, for use with an internal combustion engine having means (1) providing ignition control signals;

an ignition coil (24) having a primary winding (14) storing electromagnetic energy upon flow of current through the primary winding;

a main transistor (15) connected in series with the primary (14) of the ignition coil;

current sensing means (13) connected to the primary (14) of the ignition coil and sensing current flow therethrough and providing a current output signal representative of said current flow through the primary of the ignition coil;

an auxiliary transistor (11) connected in parallel with the primary of the ignition coil (14) and establishing a shunt circuit with the ignition coil when said auxiliary transistor is controlled to be conductive, the main transistor (15) and the auxiliary transistor (11) being of the same conductivity type;

a threshold switch (17) having switching hysteresis, connected to and controlled by said current sensing signal;

a logic circuit (2, 3) connected to and controlled by said ignition control signals and by said threshold circuit (17) and respectively, alternatingly controlling conduction, or blocking, of said main transistor (15) and said auxiliary transistor (11), so that, when the main transistor (15) is conductive, said auxiliary transister will be blocked, and vice versa, said threshold switch (17) and said logic circuit controlling the auxiliary transistor (11)

(a) to become conductive when the current through the primary (14) of the ignition coil rises above a first, higher predetermined threshold level to thereby close said shunt circuit around the primary (14) of the ignition coil and (b) to block, when the current through the primary of the ignition coil drops below a predetermined second, lower threshold level to open the shunt circuit across the primary (14) of the ignition coil, the auxiliary transistor (11), the current sensing means (13) and the primary (14) of the ignition coil forming a closed series circuit when the auxiliary transistor (11) is closed;

a control transistor (5) connected to said logic circuit (2,3);

a voltage divider circuit (6,7) having a tap point, connected to an emitter-collector path of said control transistor (5);

and a capacitor (9) and a diode (10) serially connected to the tap point of said voltage divider, the auxiliary transistor (11) being controlled from the junction of said diode and capacitor.

2. System according to claim 1, wherein said main transistor (15) and said auxiliary transistor (11) are of the same conductivity type, the junction between said capacitor (9) and said diode (10) being connected to a base of said auxiliary transistor (11).

* * * * *